United States Patent [19]

Alsterhäll

[11] Patent Number: 4,872,952

[45] Date of Patent: Oct. 10, 1989

[54] METHOD FOR MANUFACTURING A BOARD- OR SHEET-SHAPED MATERIAL WITH A HIGH PROPORTION OF GLASS OR MINERAL WOOL FIBRES

[75] Inventor: Lars Alsterhäll, Svanskog, Sweden

[73] Assignee: Swanboard Masonite AB, Svanskog, Sweden

[21] Appl. No.: 50,424

[22] Filed: May 18, 1987

[30] Foreign Application Priority Data

May 16, 1986 [SE] Sweden ..... 8602231

[51] Int. Cl.[4] ..... D21H 5/18

[52] U.S. Cl. ..... 162/152; 162/156

[58] Field of Search ..... 162/3, 152, 156, 145

[56] References Cited

U.S. PATENT DOCUMENTS

| | | | |
|---|---|---|---|
| 2,510,086 | 6/1950 | Delloye | 162/156 |
| 2,787,542 | 4/1957 | Labino | 162/156 |
| 3,758,375 | 9/1973 | Keib et al. | 162/156 |
| 3,838,995 | 10/1974 | Smith | 162/156 |

FOREIGN PATENT DOCUMENTS

| | | |
|---|---|---|
| 136542 | 10/1977 | Denmark . |
| 2230477 | 12/1974 | France . |
| 82428 | 1/1935 | Sweden . |
| 400964 | 4/1978 | Sweden . |
| 1277658 | 6/1972 | United Kingdom . |

*Primary Examiner*—Peter Chin

*Attorney, Agent, or Firm*—Cushman,Darby & Cushman

[57] ABSTRACT

A method and a device for manufacturing a board- or sheet shaped material with a high amount of glass or mineral wool fibres and produced in e.g. a board- or paper making machine. The purpose of the invention is to provide a wetting of the fibres and a distribution of them in aqueous phase so that they can be mixed with the other ingredients, paper pulp and binding agent, to a mass with the desired composition. The fibres are fed in air stream into a cyclon, after the outlet of which the fibre stream is accelerated under simultaneous supply of water or steam, which replaces the air about the fibres. The wetted fibres are then mixed with paper pulp and binding agent and supplied to a device for producing a board- or sheet-shaped material, such as a board- or paper making machine.

5 Claims, 2 Drawing Sheets

METHOD FOR MANUFACTURING A BOARD- OR SHEET-SHAPED MATERIAL WITH A HIGH PROPORTION OF GLASS OR MINERAL WOOL FIBRES

BACKGROUND OF THE INVENTION

Asphalted roofing-board is a common roofing material. The expansion of such a material due to moisture pick-up amounts to about 3–4%. There has been a long-felt need for a board-or sheet-shaped material for the above or similar purposes, which material has a considerably lower expansion, i.e. a higher dimensional stability.

Paper materials with a high amount of glass or mineral fibres are previously known through, e.g. GB-A-1,277,858 and DK-B-136-542. A problem when handling glass and other mineral fibres and mixing them into wet masses, is to provide a wetting of the fibres, so that the fibers, by simple means, can be kept separated in the mass.

In US-A-2,787,542, there is described a device for manufacturing a paper-like material with a high amount of glass fibres. The fibres are delivered into a hood, where they are hit by water sprays so that they are wetted. Water and fibres are then carried downwardly into a pulp vat of a paper-making machine. The fibres in this case have to be easily wettable, and the device would not work for fibres which e.g., contain a binding agent, like e.g., phenolic resin.

SUMMARY OF THE INVENTION

An object of the present invention is to provide a method of manufacturing a cellulose fibre-based material with a high amount of glass or mineral fibres. This method provides the required wetting of the fibres and a separation thereof, so that they easily can be mixed with the other ingredients to create a mass which can be treated in the intended way.

The object has been met by providing a method comprising the following steps; feeding the fibres in an air stream into a cyclone; permitting the fibre stream to pass pass through the cyclone; accelerating the fibre stream after the outlet from the cyclone under simultaneous supply of water or steam, which replaces the air about the fibres and provides a wetting thereof; separating the wetted fibres in aqueous phase and mixing them with paper pulp and binding agent; and supplying the mixed mass of fibres, paper pulp and binding agent to a device for producing a board- or sheet-shaped material, such as a board- or paper making machine.

A further purpose of the invention is to provide a device for performing the above method. This purpose has been met by providing a device comprising a cyclone: feeding means for feeding the fibres in an air stream to the cyclone; an acceleration device for the fibre stream arranged at the outlet of the cyclone; means for supplying steam or water to the fibre stream in the acceleration device; and a collecting vessel for the fibre/water mixture; and means for supplying paper pulp and binding agent to the mixture and a device for manufacturing the desired board- or sheet-shaped material of the mixture of fibres, paper pulp and binding agent, as a board- or a paper making machine.

BRIEF DESCRIPTION OF THE DRAWINGS

The invention will now be described more in detail with reference to some embodiments illustrated in the accompanying drawings In the Drawings.

DETAILED DESCRIPTION

According to an embodiment of the invention, a porous board plate with a high amount of glass fibres is produced. This board plate has a volumetric weight of 0.30–0.30 ton/m$^3$ and an expansion (dimensional stability) of less than 1.5%, in tests where the plates are immersed in water until the expansion has ceased. These quality factors are obtained for the following composition: 55–75% glass wool, 10–20% newsprint paper pulp, and 10–25% binding agent in the form of asphalt and phenolic resin. According to a preferred embodiment, about 60% glass wool is contained, about 19% each of newsprint paper pulp and asphalt and about 2% phenolic resin. A polymer can also be added in an amount of about 0.1%, in order to improve the retention and dehydration of the mass.

The paper pulp contributes to the strength of both the wet and the dry sheet and is a condition for making the mass feasable to be run through a conventional board-making machine. The binding agents asphalt and phenolic resin are used to give the plates the required dry strength.

According to a second embodiment, a sheet-shaped material is produced by running the mass through a paper-making machine. In this case the paper pulp content must be higher, up to 50% and the glass fibre content lower, from 30%. As binding agents, asphalt and phenolic resin may be used in this case.

As stated above, the problem when handling glass fibres and mixing them into wet masses is to provide a wetting of the fibres and a separation thereof in aqueous phase so that they, e.g. by means of a static mixer can be easily mixed with the other ingredients to provide a mass which can be treated in the intended way.

Figure 1:
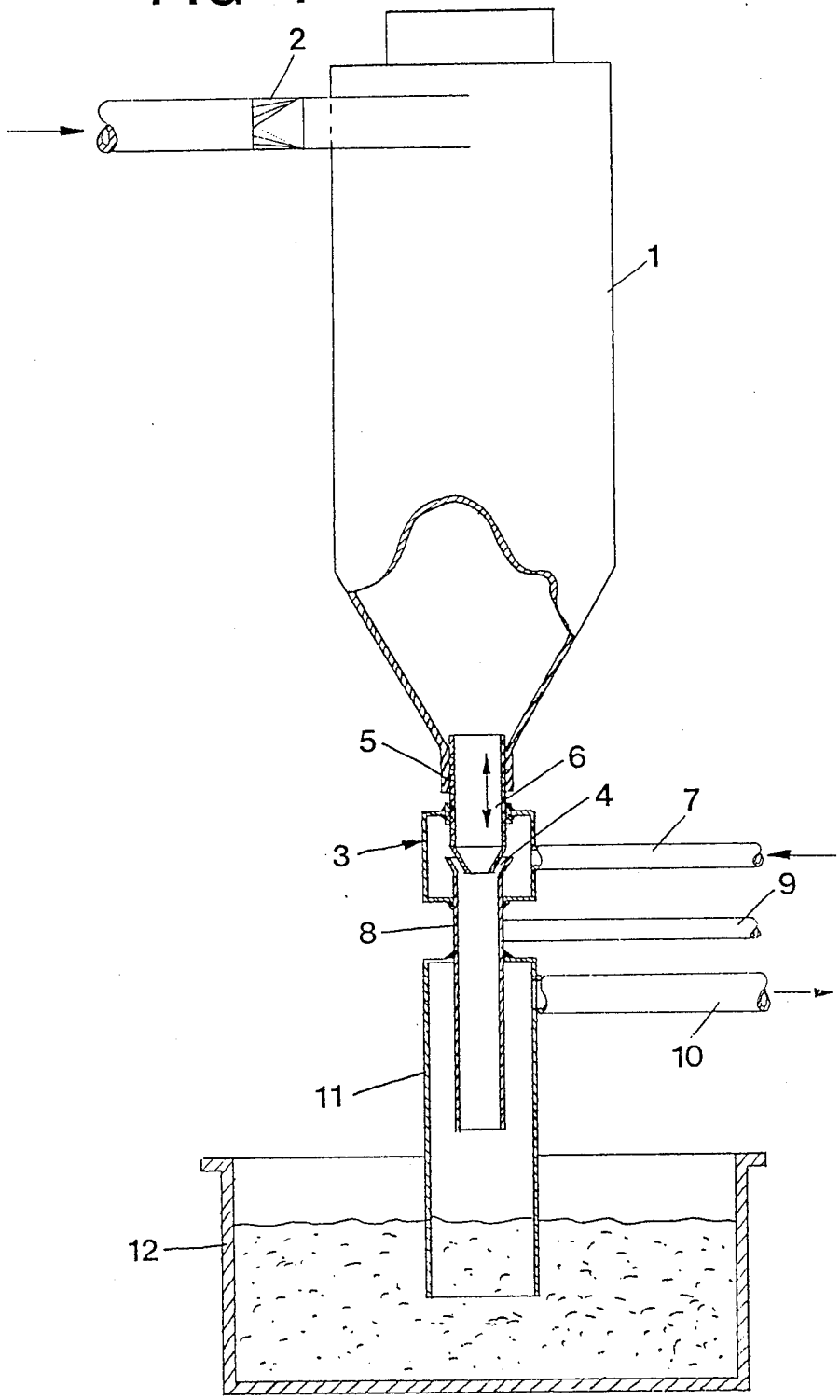
FIG. 1 shows schematically a first embodiment of a device for wetting the glass fibres.

In FIG. 1, the numeral 1 denotes a cyclone, into which the glass fibres are fed by means of an injector fan 2. The cyclone preferably works with air circulation, so that instead of blowing out the air through the chimney in the usual way the air is led back to the cyclone. By using such a construction and technique, the fibers are prevented from being blown out through the chimney.

At the outlet of the cyclone 1 there is arranged an ejector member 3, the ejector opening 4 of which is adjustable by means of threads 5 between the lower portion of the cyclone 1 and the ejector tube 5. Steam or water is supplied to the ejector member 3 through a supply conduit 7. After the ejector, there is arranged a chute 8, to which water, possibly together with paper pulp, is supplied through a conduit 9. An outlet 10 for steam is arranged in a tube 11 surrounding the outlet end of the chute 8, the tube 11 reaching into a collecting vessel 12.

When feeding the fibre material into the cyclone 1 by means of the injector fan 2, granule wads are disintegrated into separate granules. During the very rapid acceleration which occurs in the ejector the granules are separated into smaller tufts of fibres. In addition the air in the fibre material is replaced with steam or water.

A further fine separation of the material into separate fibres takes place at the retardation when steam and fibre tufts contact the water supply in the chute 8. Steam is condensed to water and there is obtained a finely separated fibre material in aqueous phase in the collecting vessel 12. Possible surplus steam is blown out through the outlet 10.

The fibre material, which is finely separated in aqueous phase, is then fed to an uptaking machine, in which the other ingredients are added, i.e. newsprint paper pulp (if this has not already been supplied through the conduit 9), asphalt, phenolic resin and, optionally polymer. The mixture is then run through a porous board making machine for manufacture of a porous asphalt-impregnated board plate with a high amount of glass or other mineral wool fibres, e.g. rock wool fibres, or through a paper-making machine, for manufacture of a sheet-shaped material.

Figure 2:
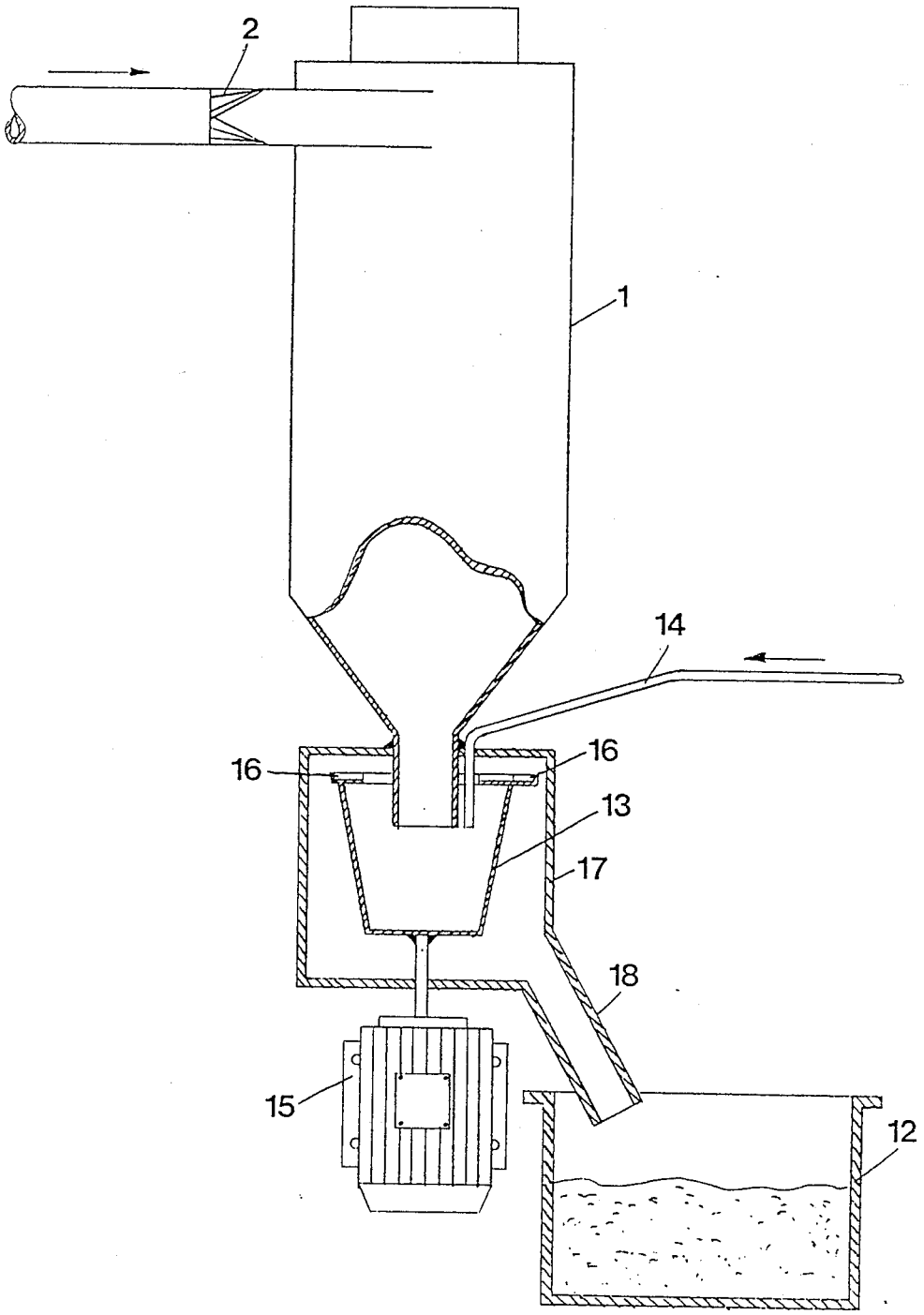
FIG. 2 shows schematically a second embodiment of a device according to FIG. 2.

In the embodiment according to FIG. 2, there is, after the cyclone 1 arranged a centrifuge 13, into which a supply conduit 14 for water reaches. The centrifuge motor is denoted by the numeral 15. A the upper part of the centrifuge, there is arranged a plurality of (e.g., three), radial outlets 16 from the centrifuge 13. The centrifuge 13 is enclosed by a housing 17 with an outlet tube 18, which reaches into the collecting vessel 12.

When fibre material is fed into the cyclone by means of the injector fan 2, granule wads are disintegrated into separate granules. Rapid acceleration in the centrifuge 13 disintegrates the granules to smaller fibre tufts, whereupon the smaller fiber tufts are forced, by centrifugal under the surface of the water, which is under a very high pressure. The air in the fibre tufts is then replaced with water.

When the wet fibre material, with a very high velocity, leaves the centrifuge 13 and is projected against the walls of the housing 17, the fibre tufts are further disintegrated into separate fibres in aqueous phase. The fibre mass is collected in the vessel 12, after which it is mixed with the other ingredients, before the mass is run through a board- or paper-making machine.

The centrifuge can be designed in other ways than shown in FIG. 2. It can e.g., consist of a cylindrical drum provided with a plurality of radial openings, through which the fibre mass can be projected out.

The term "sheet" is used herein to be generic to board, plate, paper and other sheet material.

The invention is of course not limited to the embodiments described above and shown in the drawings, but a plurality of modifications are possible within the scope of the following claims.

I claim:

1. A method for manufacturing sheet material containing a high proportion of glass wool or mineral wool fibers, comprising:

providing a cyclone having an upper inlet and a lower outlet;

injecting fibers of glass wool or mineral wool into the cyclone through the inlet, in an air stream, whereby, in passing through the cyclone in said air stream, the fibers are separated into fiber tufts, which are ejected through said outlet;

forcing a stream of fluid selected from the group consisting of steam and water into said fiber tufts as said fiber tufts emerge from said cyclone through said outlet, thereby accelerating the fibers, replacing air within and around said fiber tufts, with said fluid and wetting the fibers in said fiber tufts;

separating the resultingly wetted fibers from air which has emerged from the cyclone with the fiber tufts, to provide a wetted fiber-containing aqueous phase;

mixing the wetted fiber-containing aqueous phase with paper pulp and a binding agent to provide a mixture thereof; and supplying the mixture to an operative sheet manufacturing machine as input thereto.

2. The method of claim 1, wherein:

said stream of fluid is forced into said fiber tufts as said fiber tufts emerge from said cyclone through said outlet, by:

providing an ejector tube in said outlet, providing a chute having an inlet arranged in axial alignment with an outlet of said ejector tube; and introducing said fluid to said tufts of fibers in said air stream between said outlet of said ejector tube and said inlet of said chute; and providing said chute with an outlet disposed in a collecting vessel for collecting wetted fibers emerging from said outlet of said chute in said aqueous phase.

3. The method of claim 2, further including:

introducing a stream of water into said chute intermediate said inlet of said chute and said outlet of said chute and thereby decelerating said wetted fiber in said chute.

4. The method of claim 3, wherein:

said stream of water introduced into said chute intermediate said inlet of said chute and said outlet of said chute contains at least some of said paper pulp.

5. The method of claim 1, wherein:

said fluid is water; and said stream of water is forced into said fiber tufts as said fiber tufts emerge from said cyclone through said outlet, by:

providing a centrifuge having an axial inlet arranged to receive fiber tufts emerging from said air stream and at least one radial outlet for wetted fibers; and introducing a supply of water into said centrifuge, whereby air is displaced from the fiber tufts and the resultingly wetted fibers emerge from the centrifuge in said aqueous phase through said at least one radial outlet; and directing said aqueous phase containing said wetted fibers into a collecting vessel.

* * * * *